US007726098B2

(12) United States Patent
Doll

(10) Patent No.: US 7,726,098 B2
(45) Date of Patent: Jun. 1, 2010

(54) METHOD FOR MANUFACTURING AN INGREDIENT PACKAGE

(75) Inventor: Paul Edward Doll, Madison, WI (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 11/742,791

(22) Filed: May 1, 2007

(65) Prior Publication Data

US 2008/0271418 A1 Nov. 6, 2008

(51) Int. Cl.
*B65B 9/20* (2006.01)

(52) U.S. Cl. ..... 53/412; 53/445; 53/449; 53/451; 53/474; 53/170; 53/237; 53/239; 53/133.8; 53/552; 53/554; 53/155

(58) Field of Classification Search ..... 53/445, 53/155, 474, 451, 551, 552, 554, 412, 449, 53/133.8, 170, 237, 239, 240; 493/294; 426/394, 410, 122, 119, 120, 115; *B65B 9/10, B65B 9/20, 9/22*

See application file for complete search history.

(56) References Cited

U.S. PATENT DOCUMENTS

| | | | | | |
|---|---|---|---|---|---|
| 1,639,699 | A | | 8/1927 | Hopkins | |
| 2,154,521 | A | * | 4/1939 | Maxfield | 53/449 |
| 3,255,872 | A | | 6/1966 | Long et al. | |
| 3,385,712 | A | * | 5/1968 | Dodge et al. | 426/410 |
| 3,763,622 | A | * | 10/1973 | Stanley, Jr. | 53/449 |
| 3,795,081 | A | | 3/1974 | Brown, Jr. et al. | |
| 3,861,522 | A | | 1/1975 | Llewellyn et al. | |
| 3,889,446 | A | | 6/1975 | Simmons et al. | |
| 3,892,060 | A | * | 7/1975 | Stanley, Jr. | 53/552 |
| 3,918,235 | A | | 11/1975 | Brown, Jr. et al. | |
| 3,992,854 | A | | 11/1976 | Howell et al. | |
| 4,226,330 | A | * | 10/1980 | Butler | 383/207 |
| 4,256,256 | A | * | 3/1981 | Meyers | 426/120 |

(Continued)

FOREIGN PATENT DOCUMENTS

DE 19600530 A1 * 7/1997

(Continued)

OTHER PUBLICATIONS

Official English language translation of FR 2696995 A1, PTO 09-0039, Oct. 2008.*

*Primary Examiner*—Stephen F Gerrity
(74) *Attorney, Agent, or Firm*—Fitch, Even, Tabin & Flannery

(57) ABSTRACT

Tandem, vertically-aligned vertical form, fill, and seal (VFFS) assemblies enable a method for manufacturing an ingredient package. An inner ingredient-bearing package is manufactured by a first superior VFFS assembly, which inner package is then downwardly displaced to a second inferior VFFS assembly. The inner package and a second ingredient are deposited (filled) into an open-ended outer packaging material being formed by the inferior VFFS assembly. After deposing the inner package and the second ingredient into the formed outer package, the outer package and inner package are sealed to one another at superior ends thereof to finally form an ingredient package. The finally formed package may be removed from partially formed packages in superior adjacency thereto. The finally formed package compartmentalizes the first and second ingredients for later consumer consumption.

20 Claims, 11 Drawing Sheets

U.S. PATENT DOCUMENTS

| | | | | |
|---|---|---|---|---|
| 4,407,339 | A | 10/1983 | Kostner et al. | |
| 4,495,748 | A | 1/1985 | Rowell | |
| 4,509,642 | A * | 4/1985 | Rowell | 206/219 |
| 4,679,701 | A | 7/1987 | Ackermann et al. | |
| 4,681,228 | A | 7/1987 | Kerry et al. | |
| 4,734,956 | A * | 4/1988 | Frey et al. | 53/170 |
| 5,024,041 | A * | 6/1991 | Urban et al. | 53/449 |
| 6,729,108 | B2 | 5/2004 | Tsuruta | |
| 6,868,650 | B2 * | 3/2005 | Sanchez | 53/551 |
| 6,935,086 | B2 | 8/2005 | Brenkus et al. | |
| 2003/0172624 | A1 | 9/2003 | Bartel et al. | |
| 2004/0226849 | A1 | 11/2004 | Brenkus et al. | |

FOREIGN PATENT DOCUMENTS

| | | | |
|---|---|---|---|
| EP | 1246765 | B1 | 10/2004 |
| FR | 1252916 | | 2/1961 |
| FR | 2696995 | | 4/1994 |
| FR | 2696995 | A1 * | 4/1994 |
| JP | 9-124051 | A | 3/1997 |
| JP | 10-230907 | A | 9/1998 |
| JP | 2002-234547 | A | 8/2002 |
| WO | 94/27886 | A1 | 12/1994 |
| WO | 2006127186 | | 11/2006 |

* cited by examiner

METHOD FOR MANUFACTURING AN INGREDIENT PACKAGE

FIELD

The present disclosure generally relates to methods for manufacturing an ingredient or foodstuff package having distinct ingredient or foodstuff compartments. More particularly, the present disclosure relates to an ingredient package manufacturing method which enables package formation via tandem vertical form, fill, and seal assemblies.

BACKGROUND

Gasified candy, when exposed to moisture, tends to melt when in prolonged contact therewith. Given a sufficient amount of exposure to moisture (as for example, when exposed to one's mouth), the candy shells surrounding carbon dioxide gas bubbles essentially melt thereby releasing carbon dioxide gas, which action is often described as a popping sensation in one's mouth. The candy, to have its intended affect, should preferably be melted at the time of consumption and therefore separated from ingredients that may tend to otherwise prematurely melt the candy shells and release the popping gas. The candy, however, is often times enjoyed in conjunction with other food items or foodstuffs having significant moisture content such as pudding. In order to successfully serve both pudding and gasified candy for simultaneous consumption, it is necessary to separate the two ingredients prior to consumption. Packaging that enables the consumer to simultaneously and conveniently carry both ingredients in a single package for simultaneous consumption and enjoyment is therefore desirous.

Gasified candy and pudding are exemplary ingredients, however. Other foodstuffs or ingredients that may benefit from compartmentalized separation prior to consumption include any number of probiotic products and/or products containing active cultures such as yogurt or cottage cheese juxtaposed against other sugary ingredients or foodstuffs such as fruit, fruit-based ingredients, jams, and jellies. Some of the more pertinent prior art relating to packaging directed to compartmentalizing ingredients or constituent parts prior to active admixture and the like is described hereinafter.

U.S. Pat. No. 3,861,522 ('522 Patent), which issued to Llewellyn et al., discloses a Compartmented Package having Variable Volume Compartments. The '522 Patent teaches a compartmented package in which a longitudinal diaphragm, made of film, is sealed to the inner wall of a circular tubular member, also made of film, to form at least two continuous longitudinal linear junctures therebetween in a manner such that the volumes of the resulting compartments are variable. A two-compartment package having infinite relative volume variability in both compartments is stated to be the preferred embodiment.

U.S. Pat. No. 4,495,748 ('748 Patent), which issued to Rowell, discloses certain Containers and Machine for Making Them. The '748 Patent teaches a container preferably made from sheet plastics comprising a bag containing a tubular valve member, the bag being sealed with a seam at each end, the top seal having an opening therein for entry of an access tube into the valve member, and the valve member having a sealing seam which facilitates piercing of the access tube through the valve member into the bag. A second bag may be provided within the first bag. A machine is disclosed for making the containers continuously from sheets of material.

U.S. Pat. No. 4,681,228 ('228 Patent), which issued to Kerry et al., discloses a Package Filled with a Water Soluble Toxic Pulverulent or Granular Product. Kerry et al. note that some chemical products are so toxic that they must not come into contact with parts of the human body. The '228 Patent teaches a package of such a construction that during filling and transport thereof and during the release of product therefrom, the risk of anyone coming into contact with the product is restricted to a minimum, is characterized in that the product is situated in a closed inner container consisting of a water-soluble flexible material, and that the filled inner container is placed inside a closed outer container consisting of a flexible material which is resistant to water, both the inner container and the outer container consisting of a flexible tube which is closed near the two ends by a transverse joint and the end strips of the inner container are connected to the joining strips of the outer container in a manner such that between the contents of the inner container and the said joining strips there is a certain distance, and that a tear line is made in an exposed part of one of the end strips of the inner container.

U.S. Pat. No. 6,935,086 ('086 Patent), which issued to Benkus et al., discloses a double-bag package, and method for manufacturing the same, constructed by modification to existing Double Bag Package and Perforation Knife. The '086 Patent teaches certain form and fill packaging machines and perforation knives. In a preferred embodiment thereof, a double-bag package is produced from a single sheet of packaging film by feeding a roll of film having graphics printed sideways rather than vertically into a vertical form, fill and seal packaging machine and using a novel perforating/cutting knife to alternately cut and perforate transverse seals. The perforating/cutting knife has teeth in the shape of oblique triangular pyramids, with each tooth having three cutting edges. The perforating/cutting knife produces self-correcting T-shaped perforation patterns capable of capturing and redirecting errant tears for fail-safe directional separation.

International Publication No. WO 94/27886, authored by Richter et al., discloses a Container with Multiple Chambers, to Package Components Separately Prior to Use in Admixture. The Richter et al. publication teaches a package for accommodating a product having at least two components, which package has at least two self-contained chambers in which the individual components of the product can be stored in such a manner that they are hermetically separated from one another. The individual chambers are connected together in such a manner that they can be separated from one another only by destroying at least one chamber wall. The end regions of the chamber walls are in the form of a common closure for the individual chambers such that the individual chambers can only be opened simultaneously. In the preferred embodiment, the package comprises at least one folded carton having essentially a front and a back wall, side walls, bottom flaps and top flaps, inside which carton are arranged in a fixed manner at least two tube-like inner sachets each of which accommodates one of the components directly and which represent the chambers for the individual components, and the top end regions of which that project out of the inside of the folded carton form the common closure after the inner sachets have been filled separately.

From a review of these publications and other prior art generally known in the relevant art, it will be seen that the prior art does not teach a package for coaxially aligning and compartmentalizing constituent ingredients of a final mixture. Further, the prior art does not teach certain methodology for finally serving foodstuffs or presenting ingredients by axial displacement relative to package assembly, whereby plural foodstuffs or ingredients are coaxially presented for mixture at the time of consumption. The prior art thus perceives a need for a package assembly and methodology associated therewith that provides consumers with a novel means for receiving and consuming multiple ingredients, the admixture of which has arguably greater delectable value than the sum of its parts.

SUMMARY

Accordingly, an ingredient separating package is provided, which functions to package and present plural ingredients which may, upon presentation, affect an opportune admixture. The coaxial and non-coaxial packages comprise at least one inner tube or inner barrier, an outer tube or barrier, first and second package ends, and a longitudinal package axis extending intermediate the first and second package ends. The inner and outer tubes may extend coaxially about the package axis. The inner tube receives an inner ingredient and the outer tube receives both the inner tube, laden with the inner ingredient, and an outer ingredient. The inner and outer tubes are sealed at the first and second package ends. The inner tube thereby prevents untimely ingredient inter-contact, the outer tube thereby seals the coaxial package from ambient matter such as air, debris, or other matter that may be considered problematic to affect a proper ingredient admixture.

The inner and outer tubes may be sealed to one another at the first and second package ends and may comprise certain manually enabled, end-opening structure as may be preferably defined by state of the art singular, paired, continuous, or skipped laser scoring. Thereby, the user may selectively unseal or open a select package end (typically the top package end as directed by external graphical indicia) and coaxially dispense the inner and outer ingredients for further effect or action.

Certain methodology is further presented as reflective of the disclosed structures in terms of coaxial and non-coaxial ingredient presentation, foodstuff service, and package manufacture. In this regard, the that ingredient packages may be finally formed by first forming an ingredient-receiving inner tube, the inner tube having first and second inner tube ends and a longitudinal tube axis, the first inner tube end being sealed, the second inner tube end being open. A first ingredient may then be properly deposited into the inner tube via the second inner tube end, the first ingredient extending in radial adjacency to the tube axis. A matter-receiving outer tube is also be formed, which outer tube has first and second outer tube ends, the first outer tube end being sealed, the second outer tube end being open. A second ingredient and the inner tube may then be deposited into the outer tube via the second outer tube end, the inner and outer tubes and the first and second ingredients being substantially coaxial. The second inner and outer tube ends may then be simultaneously sealed to one another thereby finally forming a coaxial or non-coaxial ingredient package.

DETAILED DESCRIPTION

Figure 16:
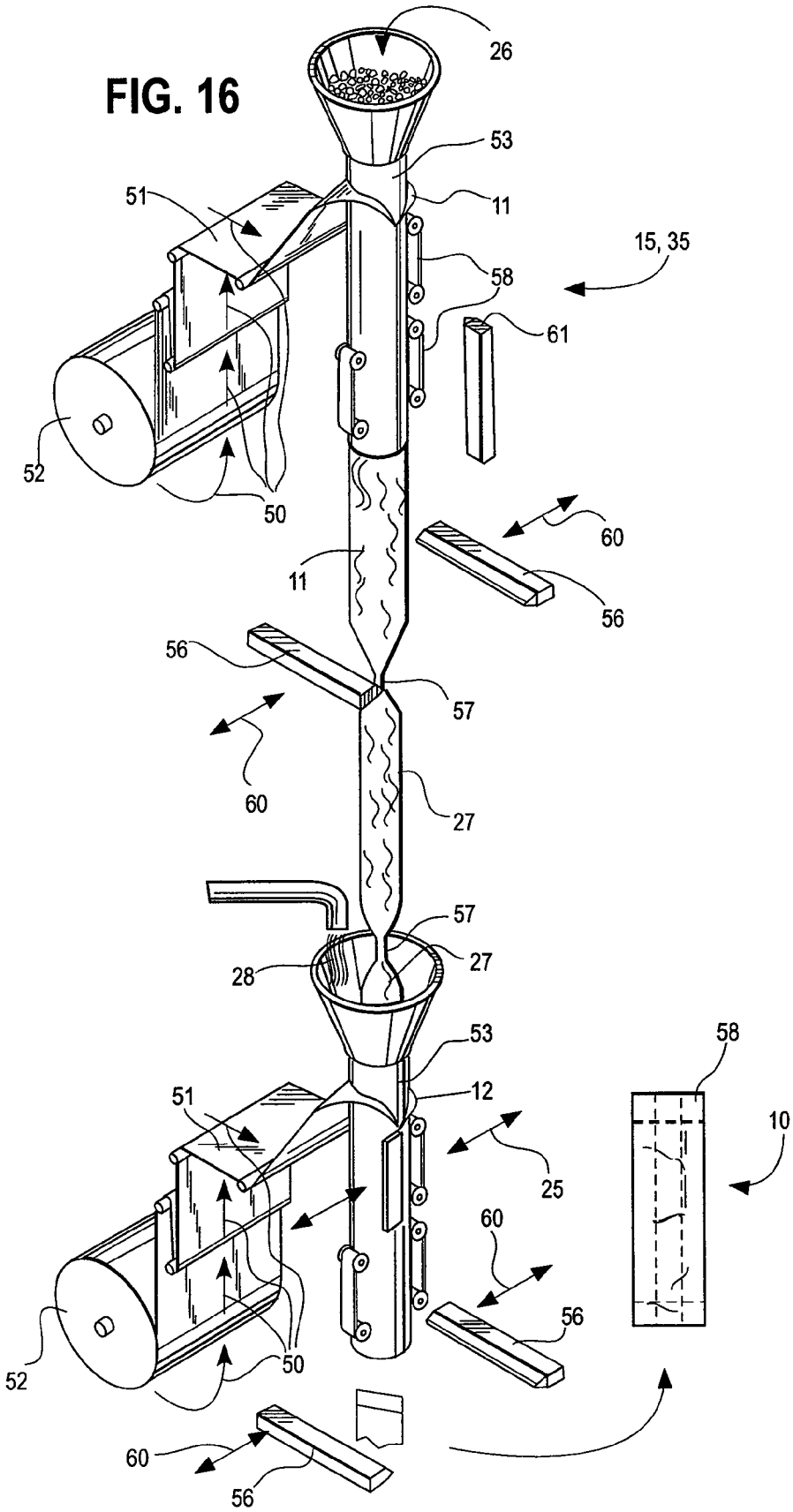
FIG. 16 is a top perspective type depiction of first and second tandem vertical form fill and seal assemblies forming the coaxial ingredient package assembly.
Figure 17:
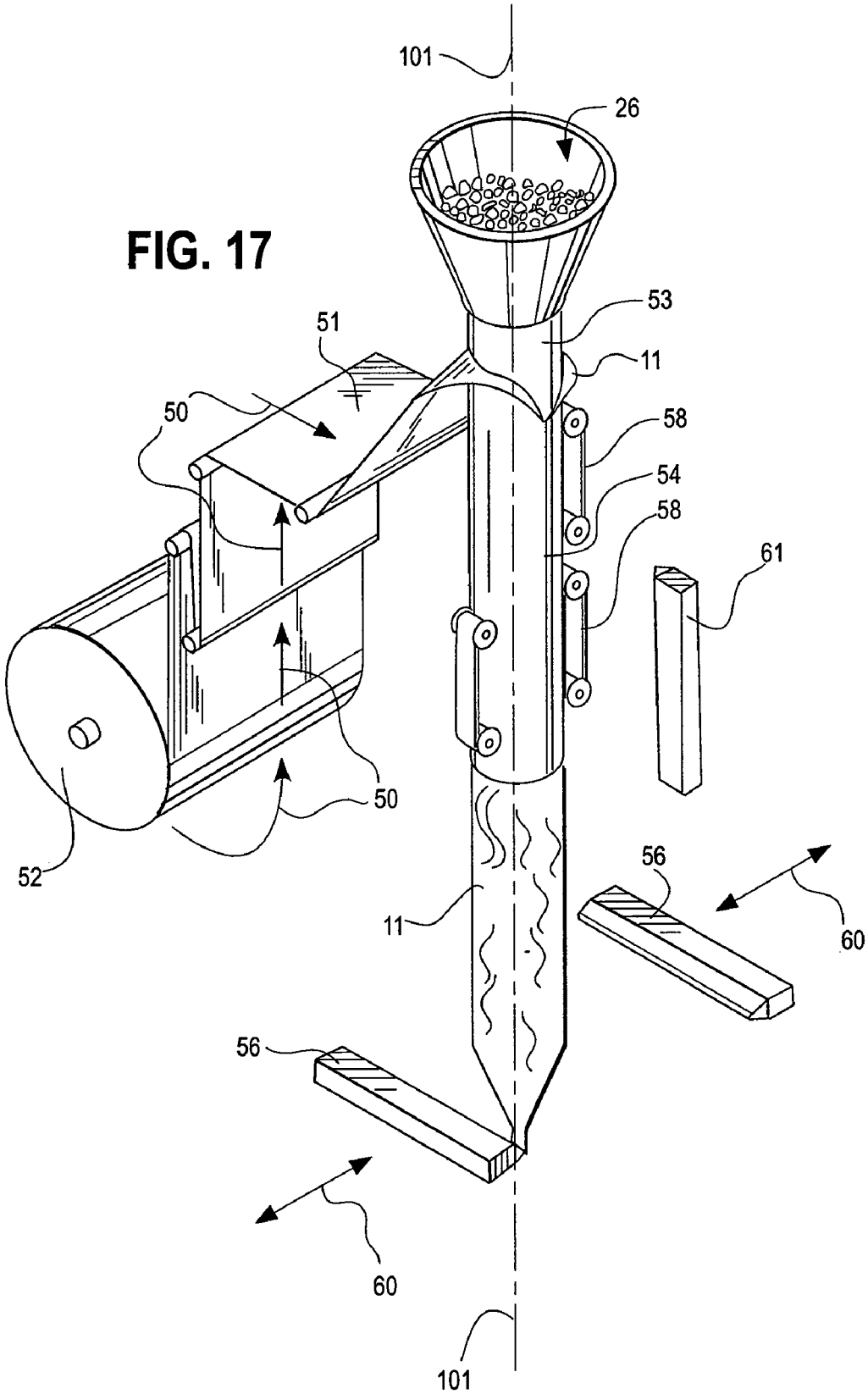
FIG. 17 is an enlarged top perspective type depiction of the superior first vertical form fill, and seal assembly shown in FIG. 16.
Figure 18:
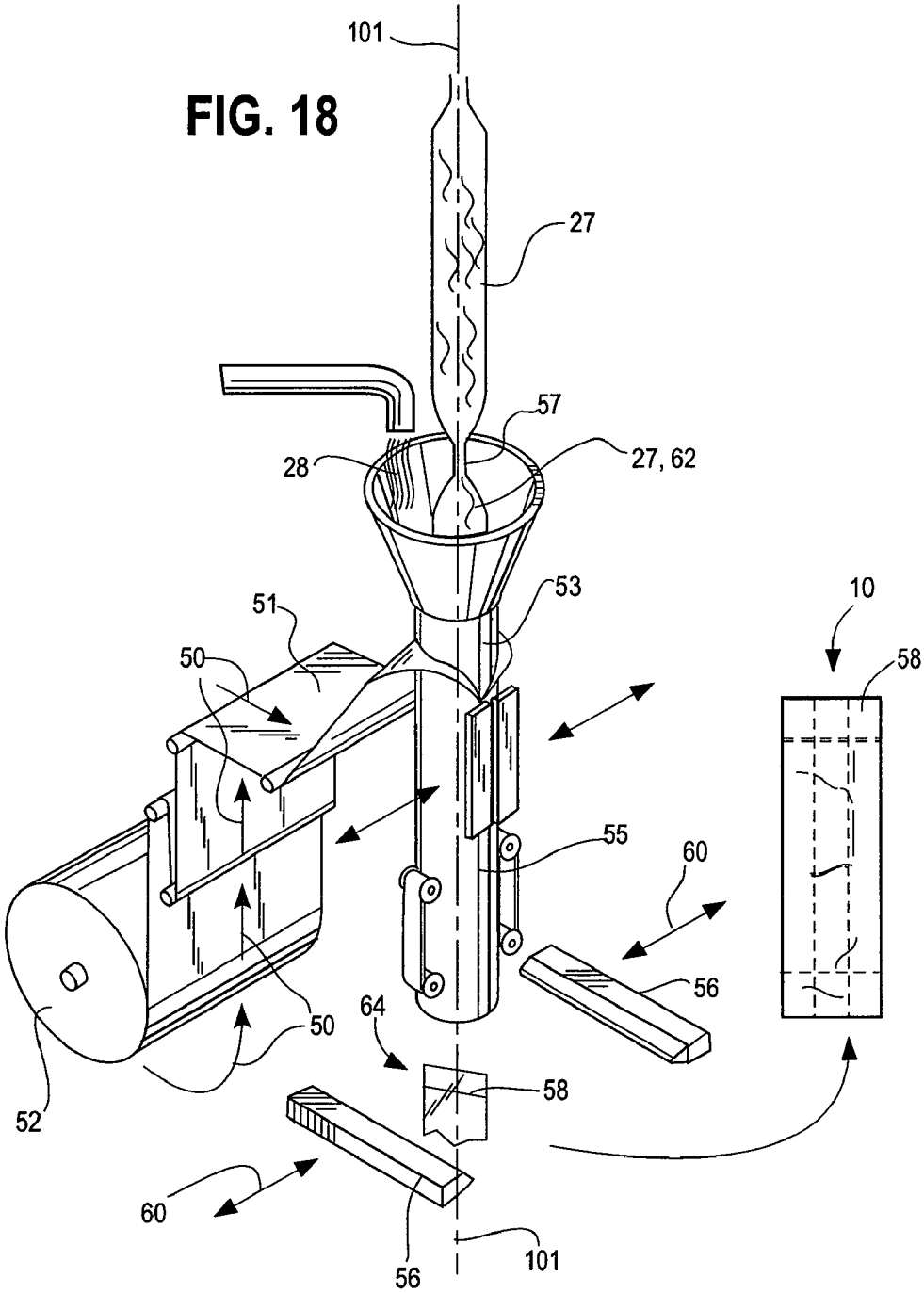
FIG. 18 is an enlarged top perspective type depiction of the inferior second vertical form fill, and seal assembly shown in FIG. 16.

Referring now to the drawings with more specificity, a preferred methodology for manufacturing the ingredient or foodstuff package assembly is generally depicted in FIGS. 16-18, while an embodiment of a coaxial package assembly 10 is generally illustrated and referenced in FIGS. 1-5, 14, 16, and 18. An embodiment of a non-coaxial ingredient or foodstuff package assembly 102 is generally referenced in FIGS.

19-21. The coaxial package assembly 10 is designed primarily for compartmentalizing and packaging ingredients or foodstuffs in coaxial relation to one another and for presenting the coaxially aligned ingredients or foodstuffs to the consumer. The non-coaxial package assembly 102 is designed primarily for compartmentalizing and packaging ingredients or foodstuffs to the consumer. It will be seen from a comparative inspection of FIGS. 16-18 that the method for manufacturing package assembly 10 is essentially enabled by way of vertically-positioned, tandemly cooperative vertical form, fill, and seal (VFFS) packaging machines or assemblies. In this regard, it will be seen that a first or superior VFFS packaging assembly 15 is generally depicted in FIGS. 16 and 17 and a second or inferior VFFS packaging assembly 19 is generally depicted in FIGS. 16 and 18.

As is well known in the arts, VFFS packaging machines or assemblies are commonly used for forming, filling and sealing packages of snack foods and the like. Such packaging machines or assemblies commonly direct (as at vector arrows 50) certain packaging film 51 (as pre-selected or engineered for preferably packaging the target foodstuff or ingredient) from a sheet roll 52 and forms the film 51 into a vertical tube around a product delivery cylinder or collar 53 as generally depicted and referenced in the noted figures. The vertical tube is then typically either vertically lap-sealed or vertically fin-sealed along its length to form a back seal. In this case, a lapped back seal or lap seal is preferably formed as at 54 to finally form the cylindrical superior tube 11 as generally depicted and referenced in FIG. 17, and a finned back seal or fin seal is preferably formed as at 55 to finally form the cylindrical inferior tube 12 as generally depicted in FIG. 18. The preference for the noted seals, namely lap seal 54 versus fin seal 55, is described in more detail below.

After forming the back seal, a typical VFFS machine or assembly directs (as at vectors 60) a pair of heat-sealing jaws or facings 56 against the tube to form a transverse seal 57 as further illustrated and referenced in the noted figures. This transverse seal 57 acts as the top seal on the inferior package as well as the bottom seal on the superior package being filled and formed above. The product to be packaged, such as certain foodstuffs or ingredients, is dropped through the product delivery cylinder or collar 53, into open-ended tube, and is held within the tube above the bottom transverse seal in substantially uniform radial adjacency to a longitudinal packaging axis. After the open-ended tube has received certain ingredients, the film tube is displaced downward to draw out another package length. A transverse seal is formed above the product, thus sealing it within the film tube and forming a package of product. It may be seen from an inspection of FIGS. 16 and 18, that inner tube 11 is transversely sealed in like manner at both its superior end and inferior end to enclose a first foodstuff or ingredient 26 in an inner package 27. In most cases, the package below said transverse seal is separated from the rest of the film tube by cutting across the sealed area. In this case, however, inner package 27 is not separated from the continuous film in superior adjacency thereto, but rather is downwardly displaced into assembly 19. Assembly 19 thus, receives both a second foodstuff or ingredient 28 and inner package 27 as generally depicted in FIGS. 16 and 18.

Notably, from an inspection of the figures, it will be readily understood that the drawings are simplified, and do not show certain support structures that typically surround such machines or assemblies. It will be further seen, however, that packaging film 51 is taken from a sheet roll 52 and passed through tensioners that keep the film 51 taut. The film then passes over a former, which directs the film into a vertical tube around a product delivery cylinder or collar 53. In this case, as the inner tube 11 is pulled or directed downward by drive belts 58, the inner tube of film is sealed along its length by a lap sealer 61 thereby preferably forming lapped back seal 54. The machine then applies a pair of heat-sealing jaws 56 against the tube to form transverse seal 57.

As earlier specified, this transverse seal 57 acts as the top seal on the inferior package below the sealing jaws 56 (as comparatively depicted in FIGS. 16 and 18) and the bottom seal on the superior package being filled and formed above the jaws 56. After the transverse seal 57 has been formed, the package 27 is then displaced downward to draw out another package length. Before the sealing jaws 56 form the transverse seals 57, the first foodstuff 26 is dropped through the product delivery cylinder 53 and is held within the inner tube 11 above the transverse seal 57. The inner package 27 and second foodstuff 28 are then deposited into an inferior outer tube 12 formed in substantially the same manner as tube 11 (but having a larger transverse diameter). After a transverse seal 58 has been formed, the resulting coaxial ingredient package assembly 10 is then displaced downward to draw out another package length of the outer packaging film. A cut may then be made across the sealed area as at 58 to separate the finally formed package 10 from the partially formed package 10 above the seal 58.

The method of manufacture disclosed may thus be said to comprise the steps of vertically sealing longitudinal edges of a first or inner packaging material thereby forming a first tubular sleeve such as inner tube 11, having a superior and inferior open end. After forming the first tubular sleeve, the inferior end thereof is preferably transversely sealed, thereby forming an open-ended inner foodstuff-receiving compartment. A first foodstuff or ingredient may then be deposited into the open-ended inner foodstuff-receiving compartment, after which the inner foodstuff-receiving compartment may be downwardly displaced to a tube-encasing position 62 as generally referenced in FIG. 18.

Once the inner foodstuff-receiving compartment or package 27 is received at the tube-encasing position, a second outer tubular sleeve such as outer tube 12 may be formed about the inner foodstuff-receiving compartment by vertically sealing the longitudinal edges of a second packaging material at the tube-encasing position. The second or outer tubular sleeve is thereby left with opposite sleeve ends open at this juncture. The inferior end of the second tubular sleeve may then be preferably transversely sealed to form an open-ended outer foodstuff-receiving compartment, into which second foodstuff or ingredient 28 may be deposited. After the second foodstuff is deposited, the superior ends of the inner and outer foodstuff-receiving compartments may be simultaneously sealed to one another as at 58 (it being noted that transverse seal 57 is preferably sealed to seal 58 during this process) to finally form coaxial foodstuff package assembly 10. The assembly 10 may then be downwardly displaced to a cut off position, whereafter the package assembly 10 may be cut or otherwise removed from the first and second packaging materials adjacent the superior ends of the inner and outer tubes for removing the coaxial foodstuff package from the first and second packaging materials.

Stated another way, the method of manufacturing the coaxial ingredient package may be said to comprise the steps of coaxially aligning first and second ingredient-delivery cylinders or collars (such as collars 53) about a vertical tube-forming axis 101 as depicted and referenced in FIGS. 17 and 18. Notably, the step of coaxially aligning the first and second ingredient-deliver collars may be preferably defined by a substantially vertical coaxial alignment. In this regard, it will be noted that during manufacture, tube-forming axis 101 is coaxial with a package axis 100, which axis 100 is referred to in more detail below. An ingredient-receiving inner tube 11 may then be formed about the first ingredient-delivery cylinder, the inner tube being formed from a continuous sheet of first packaging film, the first packaging film having inner and outer first film surfaces. The inner first film surface may be preferably sealed to the outer first film surface as for example, via a lap-sealing process, resulting in an inner tube having open first and second inner tube ends. The first inner tube end is then preferably sealed.

After sealing the first inner tube end, a first ingredient may be delivered and deposited into the inner tube via the first ingredient-delivery cylinder and the still open second inner tube end. The inner tube and the first ingredient may then be coaxially displaced through the second ingredient-delivery cylinder, whereafter a matter-receiving outer tube (such as outer tube 12) may be formed about the inner tube via the second ingredient delivery cylinder. Similar to the inner tube, the outer tube is also preferably formed from a continuous sheet of second packaging film, the second packaging film having inner and outer second film surfaces, the outer second film surface being pre-printed or pre-provided with graphics and similar other markings for notifying onlookers of package contents. The inner second film surface is preferably vertically fin-sealed unto itself, resulting in an outer tube having first and second open outer tube ends.

Before delivering and depositing a second ingredient to the outer tube, the first end thereof may be preferably sealed about the first inner tube end. Notably, the second ingredient is deposited about the inner tube via the second ingredient-delivery cylinder and the second outer tube end, whereafter the second inner and outer tube ends may be sealed to one another thereby finally forming a coaxial ingredient package. The finally formed coaxial ingredient package may then be cut or otherwise removed from the first and second packaging films. The coaxial ingredient package may be coaxially displaced to a package removal position as at reference numeral 64 in FIG. 18 before being cut from the first and second packaging films. A select package end may be preferably (and transversely) scored after sealing the second inner and outer tube ends for enabling ease of access to the package ingredients, as described in more detail below.

It is contemplated that the finally formed coaxial package assembly 10 is designed primarily for compartmentalizing and packaging ingredients or foodstuffs in coaxial relation to one another and for presenting the coaxially aligned ingredients or foodstuffs to the consumer. In this last regard, it has been noted that certain foodstuffs and/or ingredients are often best stowed or compartmentalized until the time of consumption or admixture. Thus, the coaxial ingredient package assembly may well function to package plural ingredients or foodstuffs in distinct coaxial compartments and preferably comprises at least one plastic, pliable, or pinchable inner foodstuff barrier or tube 11 as illustrated and referenced in FIGS. 1-4, 6, and 8-13, and 16; and a plastic, pliable, or pinchable outer foodstuff barrier or tube 12 as illustrated and referenced in FIGS. 1-5, and 7-16. Further, the package assembly 10 may be said to preferably comprise first and second package ends 13 as generally depicted and referenced in FIGS. 1, 3-5, and 9-15; and a longitudinal package axis 100 as depicted and referenced in FIGS. 1-4, 8, and 14.

Figure 19:
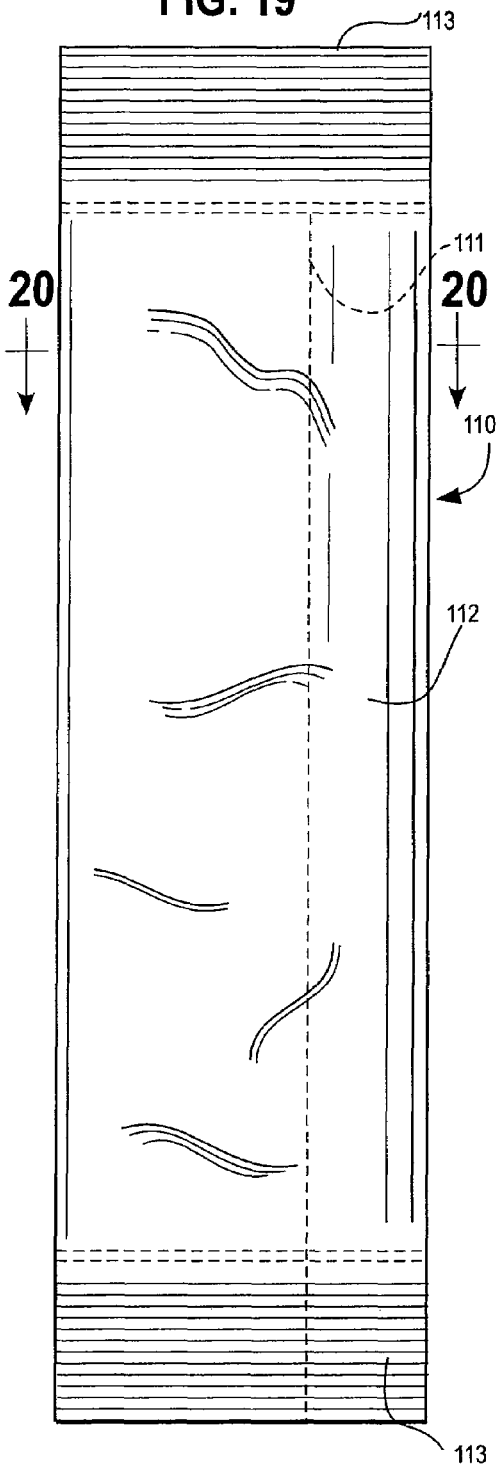
FIG. 19 is a front or top perspective view of another embodiment of an ingredient package assembly.
Figure 20:
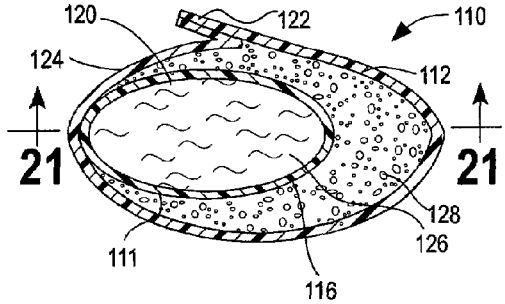
FIG. 20 is a section view of the ingredient package assembly of FIG. 19 taken along line 20-20 of FIG. 19.
Figure 21:
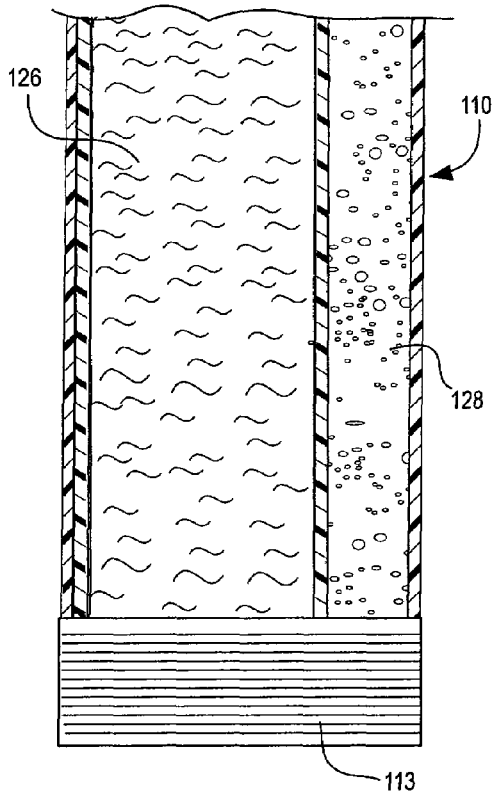
FIG. 21 is a section view of the ingredient package assembly of FIG. 19 taken along line 21-21 of FIG. 20.

Turning now to the embodiment of FIGS. 19-21, the package 102 is similar in construction and method of manufacture to that of the package 10 discussed above, but is not coaxial. More specifically, the package 102 includes and inner foodstuff barrier 111 disposed within an outer foodstuff barrier 112. The inner foodstuff barrier 111 may have an outer layer 116 that contains an inner foodstuff 126 and separates the inner foodstuff 126 from an outer layer 124 of outer foodstuff barrier 111 and an outer foodstuff 128 contained therein. The inner and outer foodstuffs 126 and 128 may be different, or they may be the same. Also similar to the previously-discussed package 10, the package 110 has sealed first and second ends 113, a lap seal 120 between ends of the outer layer 116 of the inner foodstuff barrier 111, and a fin seal 122 between ends of the outer layer 124 of the outer foodstuff barrier 112, as illustrated in FIG. 18. As illustrated in FIG. 21, the outer foodstuff 128 does not necessarily surround the inner foodstuff barrier 111.

The preferred packaging films or material structures or layers used in the construction will necessarily be based on the product(s) or ingredients being packaged by the barriers of the package. The material outer layer of the inner tube is preferably compatible with the material inner layer of the outer tube. In this regard, it is contemplated that an ethylene vinyl acetate copolymer (EVA) sealant layer may be preferably added to the outer layer of the inner tube and also added as an inner layer of the outer tube. A foil or metalized film layer may be preferably sandwiched intermediate sealant layers to affect a more robust oxygen/moisture barrier layer. Alternatively, it is contemplated that the inner tube may incorporate an extruded polypropylene (PP) or low density polyethylene for a sealant layer as well as having an extruded PP sealant layer on the outer tube.

The inner ingredient or foodstuff barrier 11 is preferably formed by way of first or superior VFFS assembly 15 as generally depicted in FIG. 16 and may preferably comprise a composite polymer material comprising state of the art materials such as polypropylene, polyester, paper, polyolefin extrusions, adhesive laminates, and other such materials. It is noted that for many ingredients, foodstuffs, or food products, flavor retention is highly important. In this regard, as is noted in the prior art, metalized food-contacting layers or surfaces provide excellent flavor retention when juxtaposed adjacent ingredients. Thus, it is contemplated that a foil or metalized film be incorporated to preferably or alternatively form an oxygen/moisture barrier layer or food or ingredient-protecting layer. The foil or metalized film layer is preferably sandwiched intermediate sealant layers. The innermost surface or layer 14 and the outermost surface or layer 16 of foodstuff barrier 11 as generally referenced in FIG. 6.

Figure 6:
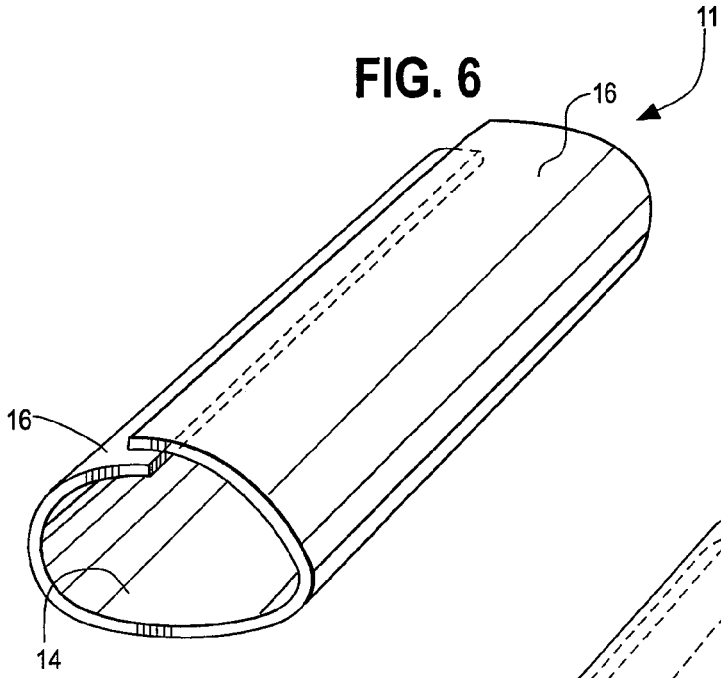
FIG. 6 is a back or bottom perspective view of an inner ingredient barrier of the coaxial ingredient package assembly configured for a lap seal type longitudinal seal.

The film composition of inner foodstuff barrier 11 generally depicted in FIG. 6 should in any event be ideally suited for use on vertical form and fill machines for the packaging of foodstuff ingredients or food products, as the methodology involved in constructing package assembly 10 preferably involves the use of tandem VFFS machines or assemblies as generally depicted in FIG. 16. Both the innermost surface 14 of barrier 11 and the outermost surface or layer 16 of barrier 11 should provide excellent food-contacting, barrier-enveloping properties (as would be the case, for example, when EVA sealant layers coat a foil or metalized film layer). Further, the outermost surface 16 of barrier 11 should enable sealing attachment to the innermost surface 14.

In this regard, it is noted that state of the art techniques for forming a preferred longitudinal lap seal may involve the use of OPP or metalized polyethylene terephtalate (PET) as an intermediate layer of a 3-layer lamination, the outer sealant layers in this case preferably being formed from EVA sealant. Excellent results may be achieved by utilizing OPP or PET coated with an EVA type sealant as the outside or outermost surface 16 of barrier 11 insofar as the same enables state of the art heat sealing of the longitudinal back seal (or transverse seal) of the film. This type of sealant further ensures a more cooperative seal with the inner most sealant layer of the outer tube. Notably, there is no requirement for an ink layer for the inner ingredient or foodstuff barrier 11 as viewable graphics and the like may be considered superfluous, the same being otherwise hidden or blocked from view by the outer barrier 12.

Figure 8:
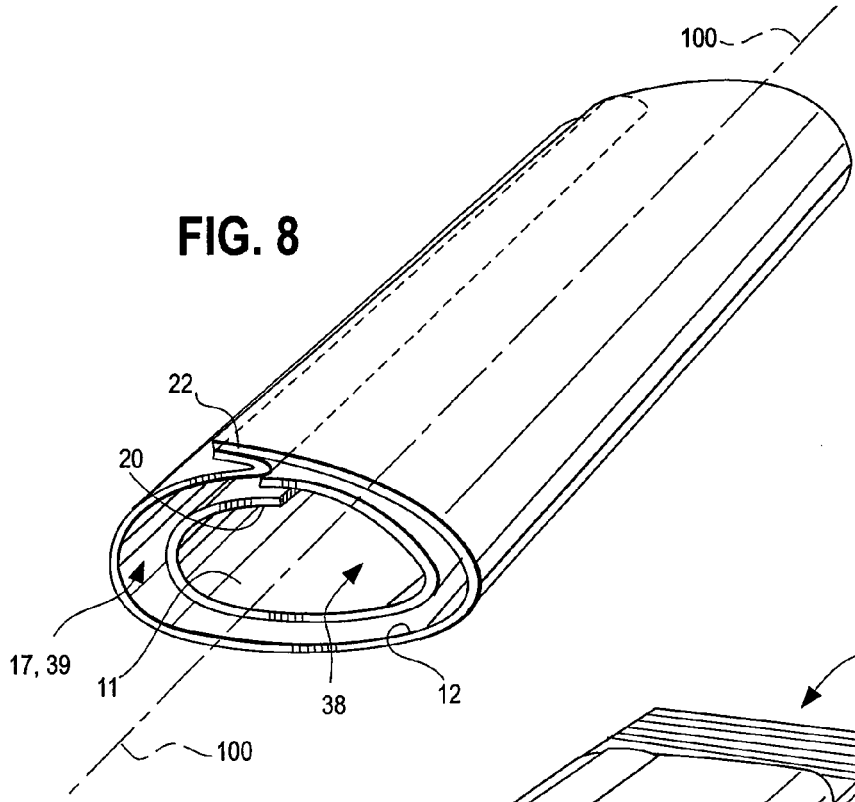
FIG. 8 is a back or bottom perspective view of the inner ingredient barrier and the outer ingredient barrier of the coaxial ingredient package assembly coaxially aligned about a longitudinal package axis.

With reference to FIGS. 6 and 8, it will be seen that a portion of the inside surface layer 14 is mated with a portion of the outside surface or layer 16 in the area indicated by an arrow (in FIG. 6) to form a lap seal 20 (referenced in FIG. 8). The lap seal 20 in this area may typically be accomplished by applying heat and pressure to the film in such area. The lap seal design shown in the noted figures thus helps to insure that the product to be placed inside the formed package will be protected or isolated from matter radially external to the inner foodstuff barrier 11.

It is contemplated that inner foodstuff barrier 11 may preferably comprises a longitudinal lap seal 20 of the type generally described and depicted in FIG. 8 so as to minimize packaging material volume extending into the interstices 17 between the inner foodstuff barrier 11 and the outer foodstuff barrier 12, which interstices 17 is generally referenced in FIG. 8. From a comparative consideration of FIGS. 2 and 8, it will be understood that providing a lap seal 20 on barrier 11 will not only minimize packaging material volume, but maximize the outer foodstuff volume 18 and minimize obstruction (s) during axial displacement of the outer foodstuff or ingredient 28. The outer foodstuff volume 18 is generally referenced in FIG. 2, and the outer foodstuff 28 is generally depicted and referenced in FIGS. 4, 9, 14, and 16.

The outer foodstuff barrier 12 is preferably formed by way of second or inferior VFFS assembly 19 tandemly juxtaposed in inferior adjacency to assembly 15 as further generally depicted in FIG. 16. Outer foodstuff barrier 12 may also preferably comprise a composite polymer material comprising state of the art materials such as polypropylene, polyester, paper, polyolefin extrusions, adhesive laminates, and other such materials. As has been noted, many foodstuffs or food products benefit from the use of a foil or metalized film oxygen/moisture barrier layer to retain food flavor. Thus, it is contemplated that a foil or metalized film barrier layer may preferably be sandwiched as the intermediate layer of a 3-layer lamination to form outer foodstuff barrier 12. The innermost layer or surface 23 and the outermost layer or surface 24 of foodstuff barrier 12 are generally referenced in FIG. 7.

Figure 7:
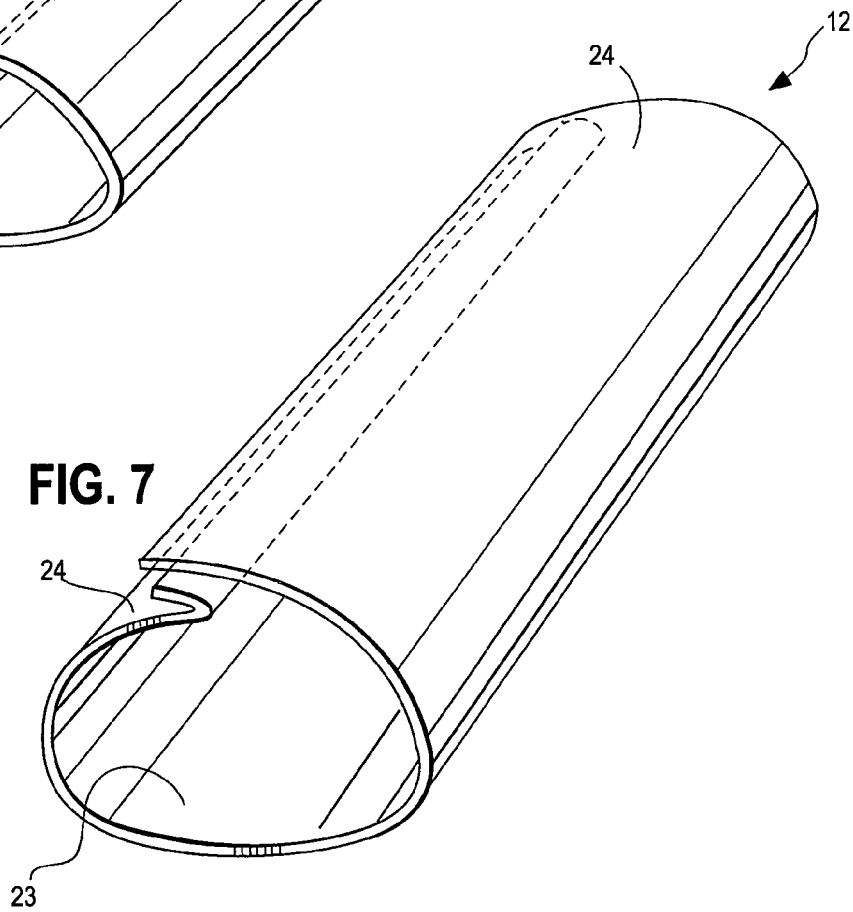
FIG. 7 is a back or bottom perspective view of an outer ingredient barrier of the coaxial ingredient package assembly configured for a fin seal type longitudinal seal.

The film composition of outer foodstuff barrier 12 generally depicted in FIG. 7 should in any event be also be ideally suited for use on vertical form and fill machines for the packaging of food-based ingredients or food products, as the methodology involved in constructing package assembly 10 preferably involves the use of tandem VFFS machines or assemblies 15 and 19. The innermost surface 23 of barrier 12 should provide excellent adhesion properties (as would, for example, an EVA sealant layer) and should enable sealing attachment unto itself. In this last regard, it is noted that state of the art techniques for forming a fin seal 22 may also involve the use of OPP or PET as the intermediate layer of a triplex film. Excellent results may be achieved by utilizing OPP or PET for the intermediate layer as sandwiched intermediate innermost surface 23 and outermost layer or surface 24 of barrier 12, the preferred EVA sealant layer of surface 23 enabling state of the art heat sealing of the longitudinal back seal (or transverse seal) of the film. Notably, outer foodstuff barrier 12 may comprise an outer ink or graphics layer for the presentation of graphics that can be viewed through a transparent outside layer 24, which outside layer 24 may be preferably defined by polypropylene or similar other material overlying the food-protecting OPP or PET materials.

Figure 1:
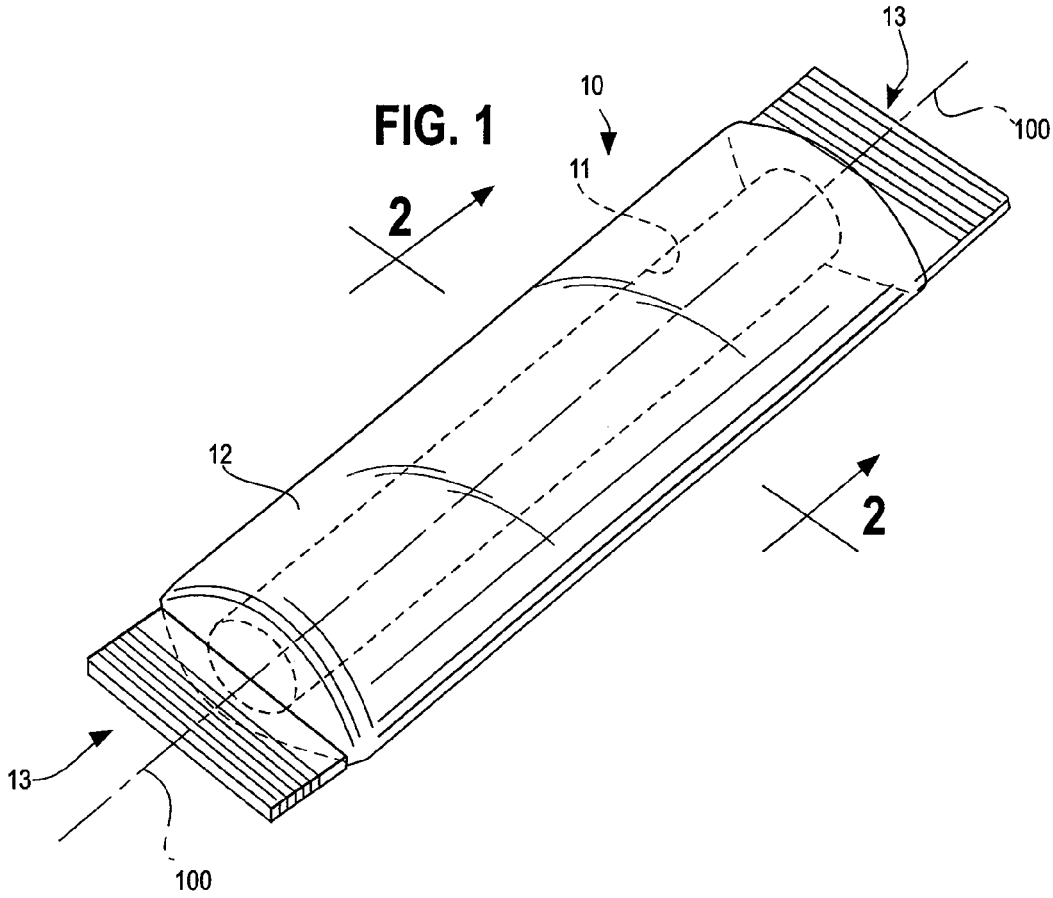
FIG. 1 is a front or top perspective view of the preferred embodiment of a coaxial ingredient package assembly.
Figure 2:
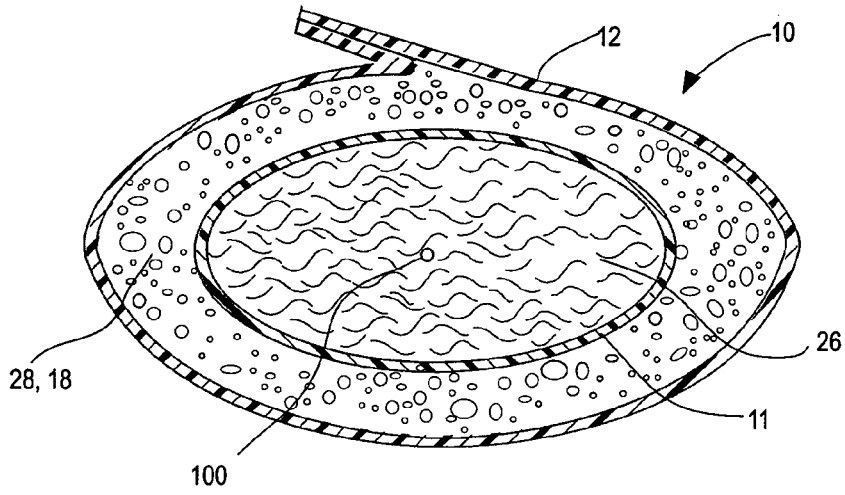
FIG. 2 is a transverse cross-sectional view of the coaxial ingredient package assembly shown in FIG. 1.
Figure 9:
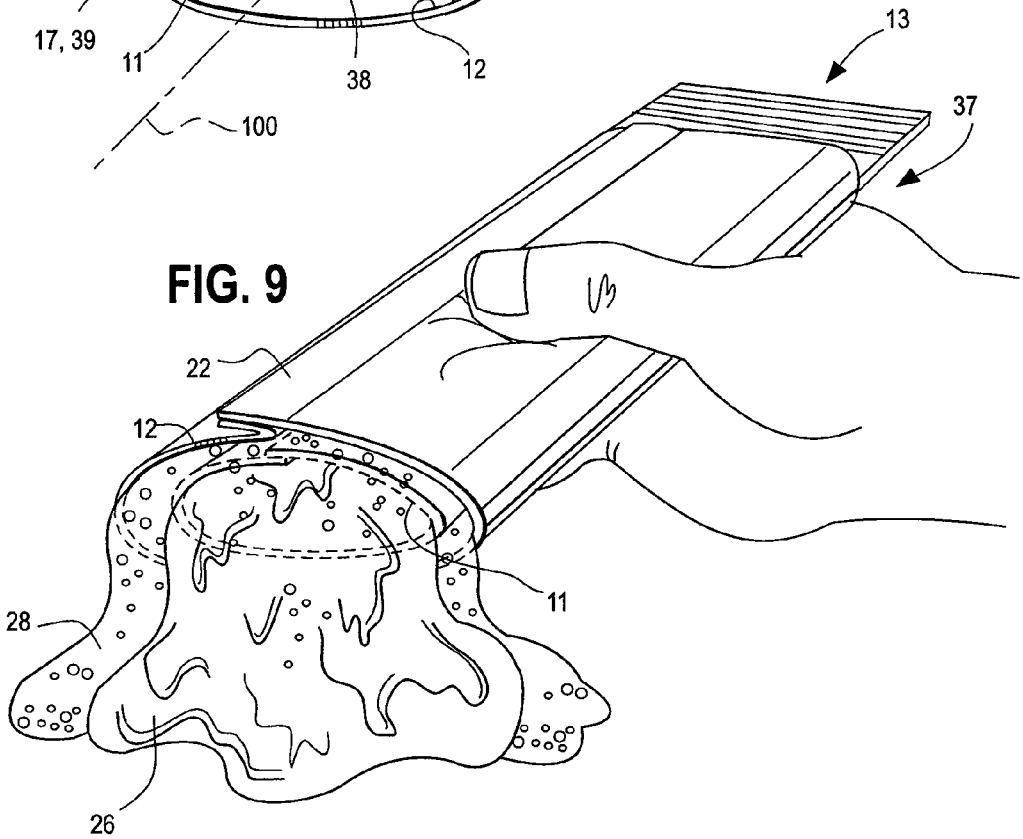
FIG. 9 is a back or bottom perspective view of the coaxial ingredient package assembly with a first end removed and depicting a user pinching or squeezing a second end to coaxially displace first and second coaxially aligned ingredients from the package assembly.

In this last regard, it will be noted that a longitudinal fin seal 22 is to be preferred for longitudinally sealing the back of outer foodstuff barrier 12, which fin seal 22 is generally depicted in FIGS. 2, 8, and 9. Outer foodstuff barrier 12 may preferably comprises a longitudinal fin seal 22 of the type generally described and depicted so as to maximize the outermost (hermetic) seal integrity of the package assembly, it being generally understood that fin seals generally provide superior hermetic seals. Further, in contradistinction to the inner lap seal 20 which functions to provide a benefit by reducing interstitial packaging material volume, there is no equal benefit of this type external to the package and thus the outer fin seal 22 is to be preferred to provide a superior seal and barrier to matter external to the package assembly 10 such as air, bacteria, debris, etc. Alternatively, however, it is contemplated that a lap seal may also be used to back seal the outer foodstuff barrier 12, for example in situations requiring conservation of materials.

The fin seal variation generally depicted also provides that the product to be placed in the formed package will be protected from the ink layer by the inside surface or layer 23. Again, the outside layer 24 does not normally contact any packaged foodstuff product. In the preferred embodiment depicted in FIG. 7, the inside surface or layer 23 is folded over and then sealed on itself in the area indicated by the arrows. Again, this seal is accomplished by the application of heat and pressure to the film in the area illustrated as may be seen from a general inspection of FIG. 16 at reference numeral 25.

It should perhaps be reiterated that the packaging materials that are fed into the form, fill and seal machines shown in FIG. 16 are preferably packaging film(s), such as polypropylene, polyester, paper, polyolefin extrusions, adhesive laminates, and other such materials, or from layered combinations of the above. For many food products, where flavor retention is important, a metalized layer may form the innermost layer, and in the case of inner foodstuff barrier 11, a metalized layer may form both the innermost surface or layer 14 and the outermost surface or layer 16.

As may be further seen from an inspection of FIG. 16, the inner foodstuff barrier 11 functions to receive an inner ingredient or inner foodstuff 26 and thereby forms an inner (food) package 27. The inner ingredient or inner foodstuff 26 is further illustrated and referenced in FIGS. 2, 4, 9, and 14. The outer foodstuff barrier 12, in turn, receives the inner food package 27 and an outer foodstuff 28 in substantially coaxial relation about the package axis 100. The inner foodstuff barrier 11 essentially functions to prevent contact intermediate the inner foodstuff 26 and the outer foodstuff 28 as further depicted in FIGS. 2, 4, 9, 14, and 16. The outer foodstuff barrier 12 essentially functions to prevent contact intermediate the outer foodstuff 28 and radially ambient matter or matter radially external to package assembly 10 (such as air or debris).

Finally, the first and second package ends 13 are preferably heat-pressure sealed to finally seal the package assembly 10. The sealed first and second package ends 13 effectively function to selectively prevent contact intermediate the inner and outer foodstuffs 26 and 28 and axially ambient matter or matter axially external to package assembly 10. In this last regard, the notion of selectively preventing contact intermediate the inner and outer foodstuffs 26 and 28 and axially ambient matter is meant to convey that the user may elect to enable contact therebetween, as for example, by opening the package assembly 10. It is thus contemplated that the coaxial foodstuff package or package assembly 10 may further preferably comprise certain manually-enabled, end-opening means for enabling a user to manually (in other words, with one's hand and/or fingers) open a select package end, the select package end being selected from the group consisting of the first and second package ends 13, but which may preferably be situated adjacent the top end as directed by implied by graphical indicia viewable via the outer package structures.

Figure 3:
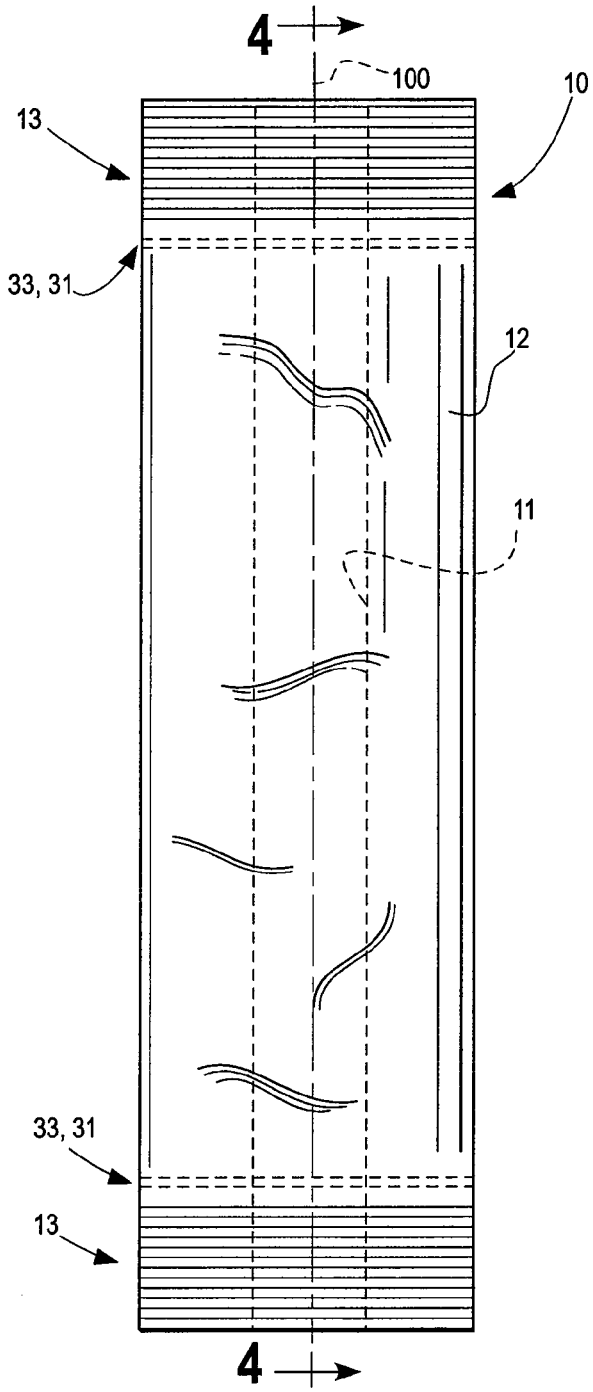
FIG. 3 is a front or top plan view of the preferred embodiment of the coaxial ingredient package assembly outlining an otherwise hidden inner ingredient compartment in broken lines.
Figure 4:
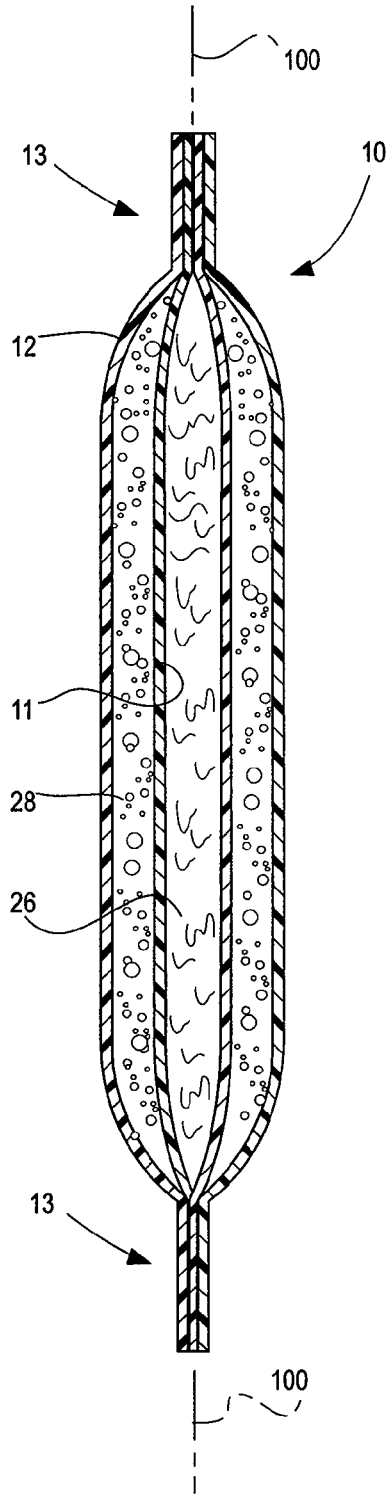
FIG. 4 is a longitudinal cross-sectional view of the coaxial ingredient package assembly shown in FIG. 3 depicting coaxial inner and outer ingredient compartments.
Figure 5:
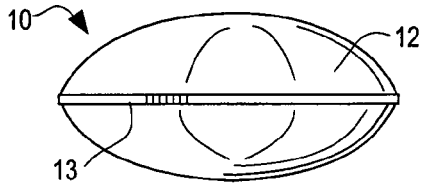
FIG. 5 is an end view of the coaxial ingredient package assembly shown in FIG. 3.
Figure 10:
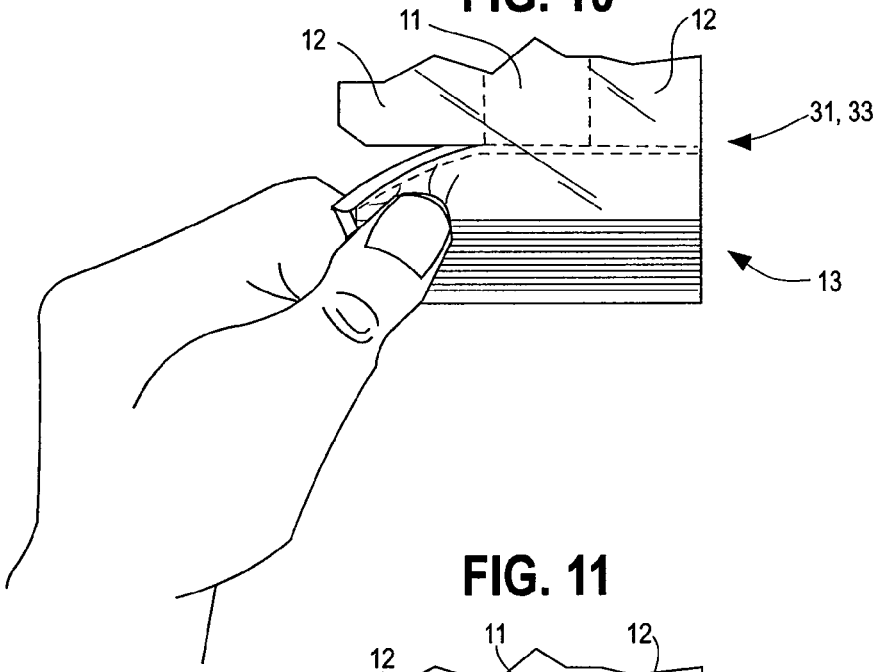
FIG. 10 is a fragmentary view of a select package end being manually removed from the coaxial ingredient package assembly depicting skipped, paired score lines to enable the manual end removal.
Figure 11:
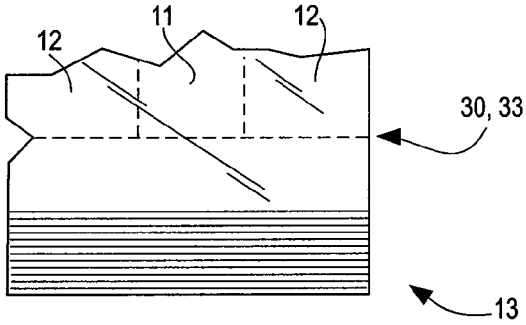
FIG. 11 is a fragmentary view of a select package end with end removal started to the left of the figure and depicting skipped, singular score lines to enable further manual end removal.
Figure 12:
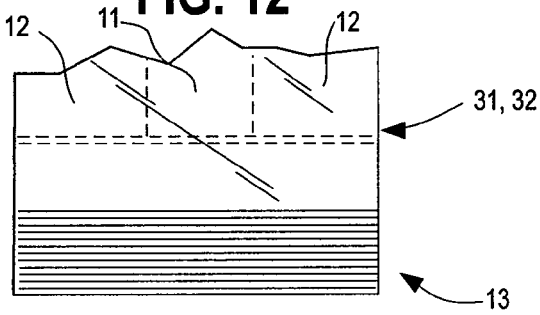
FIG. 12 is a fragmentary view of a select package end of the coaxial ingredient package assembly depicting continuous, paired score lines to enable manual end removal.
Figure 13:
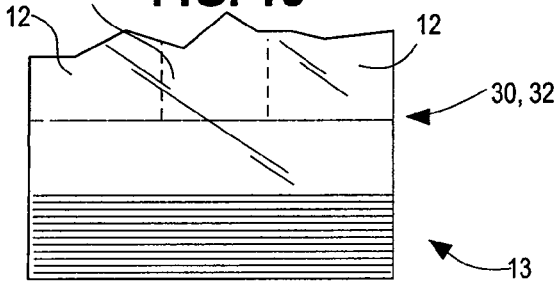
FIG. 13 is a fragmentary view of a select package end of the coaxial ingredient package assembly depicting a continuous, singular score line to enable manual end removal.
Figure 14:
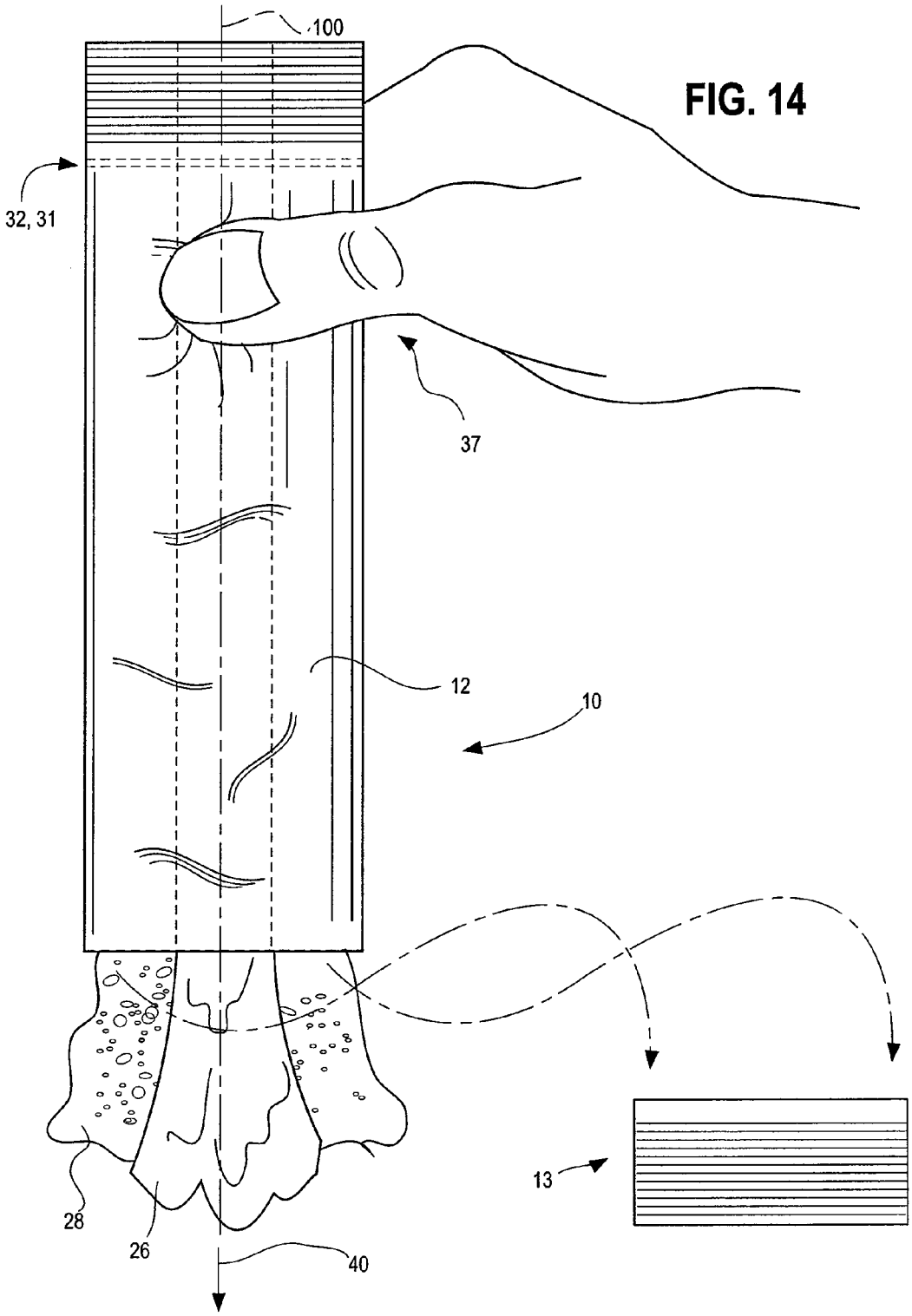
FIG. 14 is an enlarged front or top view of the coaxial ingredient package assembly with a first package end removed and depicting a user pinching or squeezing a second package end thereby manually aiding axial displacement of first and second ingredients, the first and second ingredients being coaxially presented at the opened first package end.
Figure 15:
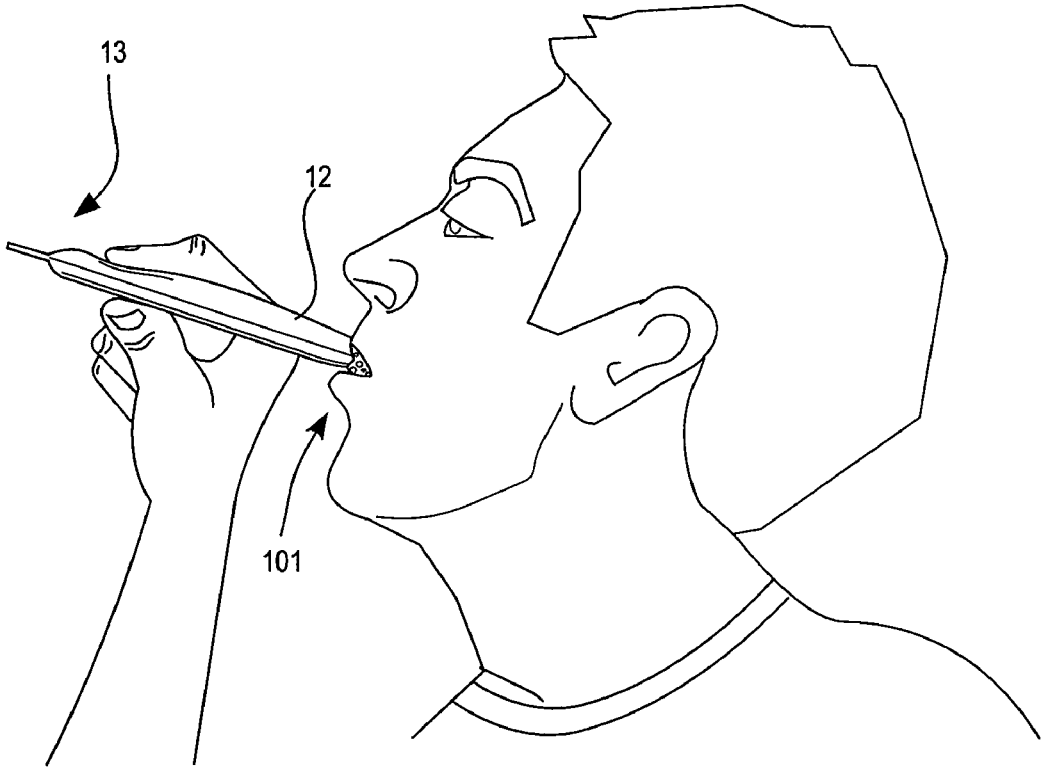
FIG. 15 is a fragmentary depiction of a user pinching or squeezing the coaxial ingredient package assembly adjacent a sealed first package end thereby axially displacing coaxially aligned first and second ingredients directly into the user's mouth via an open second package end for mouth mixing.

It is further contemplated that the end-opening means may be defined by certain select scoring as selected from the group comprising a singular score line 30 as generally depicted in FIGS. 11 and 13; paired score lines 31 as generally depicted in FIGS. 3, 10, 12, and 14; continuous score lines 32 as generally depicted in FIGS. 12-14, and skipped score lines 33 as generally depicted in FIGS. 3, 10, and 11. It will be seen from an inspection of the noted figures that the select scoring may be preferably transversely aligned or orthogonal to the package axis 100 for enabling a user to remove the select package end as comparatively depicted in FIGS. 10 and 14. It is further contemplated that the select scoring may be preferably laser scored as a means to enhance the user's ability to manually, evenly and simultaneously open the compartments 38 and 39 containing the inner foodstuff 26 and the outer foodstuff 28, respectively, to ambient matter, including, a user's mouth 101 as generally depicted in FIG. 15.

In this last regard, it is contemplated that the preferred opening technology take the form of or be defined by a laser score. The laser score will be both on the inner tube 11 and the outer tube 12. It is further contemplated that the laser score may be preferably applied while the packages are in the web configuration, prior to being formed into a tube. As heretofore stated, the score can be of many different designs; a solid score, a skip score (as shown by dotted lines), a double score where the scores are preferably about 1 mm apart making it easier to align the inner and outer scores for a clean removal of the select package end (i.e. the top) of each tube. By using a laser score the entire select package end (i.e. the top) of the tube can be removed, making the dispensing of the ingredients or inner and outer foodstuffs 26 and 28 inside much cleaner or with minimal axial obstruction(s).

The present disclosure further provides certain foodstuff service and/or presentation methodology inherently taught by the structure(s) heretofore disclosed and described. For example, a certain foodstuff service method is contemplated whereby contact between plural foodstuffs may be prevented prior to final foodstuff service. In this regard, the method is contemplated as comprising certain steps including, aligning an inner foodstuff such as inner foodstuff 26 about a foodstuff axis such as package axis 100. The step of inner foodstuff alignment may be structurally achieved by bounding or packaging the inner foodstuff with a first foodstuff barrier such as inner foodstuff barrier 11 as generally depicted in FIG. 15 at 35. The methodology may further comprise a step of coaxially aligning at least one outer foodstuff such as outer foodstuff 28 about the inner foodstuff (and the foodstuff axis). The step of outer foodstuff coaxial alignment may be structurally achieved by bounding or packaging the outer foodstuff(s) with a second or secondary foodstuff barrier(s) such as outer foodstuff 12 as generally depicted in FIG. 15 at 36.

After the respective foodstuffs are axially aligned, the same may be sealed from ambient matter (such as air or debris) for stowing and/or transporting the ingredients or foodstuffs and the foodstuffs may be unsealed or opened to ambient matter (such as a plate or one's mouth) prior to final foodstuff service. After opening or unsealing the otherwise sealed foodstuffs, it is contemplated that the methodology may involve the step of finally serving the inner and outer foodstuffs to the foodstuff consumer, as for example, by setting the coaxially aligned foodstuffs in front of the foodstuff consumer or by dispensing the foodstuffs from coaxial alignment directly to the foodstuff consumer, as for example, by dispensing the contents directly into one's mouth as generally depicted in FIG. 15.

Notably, the step(s) of foodstuff alignment and foodstuff sealing may be defined by the process of packaging the foodstuff in respective foodstuff sheathing such as inner and outer foodstuff barriers 11 and 12. Thus, the methodology here contemplated may further involve the step of preventing foodstuff contact during the step of coaxial foodstuff alignment. Further, the inner and outer foodstuffs may be simultaneously and axially displaced during final foodstuff service as for example, by squeezing, pinching (as at 37 in FIGS. 9 and 14) or otherwise forcing the foodstuffs from the structures herein specified, which structures may be defined as an inner chamber 38 and an outer chamber 39 both of which are generally referenced in FIG. 8.

In this last regard, it is contemplated that the user may elect to allow gravitational force to pull foodstuffs or other ingredient contents from the inner and outer chambers 38 and 39 as generically depicted in FIG. 14 where both gravitational force (in other words, the weight of package contents as depicted at vector arrow 40) and the user's pinching action 37 may operate to force foodstuffs 26 and 28 from chambers 38 and 39 for further processing. Thus, it may be said that inner and outer foodstuffs may be manually forced into axial displacement by pinching the foodstuffs along the foodstuff axis.

Typically, after having been finally served the foodstuffs, the user may elect to mix the foodstuffs out of coaxial or concentric alignment. This may be achieved in any number of ways, not the least of which is via mouth-mixing the foodstuffs as implicitly shown in FIG. 15. Notably, should the user elect to dispense container contents directly into one's mouth from the open select package end, admixture of ingredients may be effectively achieved thereby to effect flavor and enjoyment prior to admixed foodstuff or ingredient consumption.

It is contemplated that the process of presenting foodstuff (s) according to the teachings herein, differ somewhat from foodstuff service methodology heretofore set forth. The presentation method or method for coaxially presenting plural foodstuffs to a foodstuff consumer is believed to essentially comprise the steps of coaxially aligning a plurality of foodstuffs about a foodstuff axis. The process of coaxial foodstuff alignment is believed to set up the process of axial displacement of foodstuffs along the foodstuff axis, which process, in turn, sets up the process of coaxial presentation of foodstuffs to a foodstuff consumer. In other words, after axially displacing the coaxially aligned foodstuffs, the same may be presented to the foodstuff consumer. As before, the plural foodstuffs may be prevented from contacting one another during coaxial foodstuff alignment. Further, should the foodstuffs benefit from being sealed from ambient matter (as for example for stowage on a market shelf), it is further contemplated that the foodstuffs may be sealed from ambient matter and opened prior to axial foodstuff displacement, the displacement may be effectively achieved or effected by way of pinching action or other forceful means as heretofore contemplated.

While the above description contains much specificity, this specificity should not be construed as limitations on the scope of the invention, but rather as an exemplification of the invention. The disclosed preferred embodiments have illustrated a two chamber foodstuff package. However, a foodstuff package comprising more than two distinct compartments according to the teachings set forth herein is contemplated. Should the manufacturer elect to form three or more compartments, it is contemplated that inner barriers should take the form of inner foodstuff barrier 11 and the outermost barrier should take the form of outer foodstuff barrier 12.

Further, a foodstuff or other ingredient package for packaging and presenting plural foodstuffs or ingredients is disclosed. The package essentially comprises at least one inner foodstuff or ingredient barrier (such as barrier 11), an outer foodstuff or ingredient barrier (such as barrier 12), first and second package ends, and at least one longitudinal package axis (such as axis 100). The inner foodstuff barrier extends intermediate the outer foodstuff barrier and the package axis for receiving an inner foodstuff and forming an inner food package or packages. The outer foodstuff barrier receives the inner food package(s) and an outer foodstuff, which essentially fills the interstitial cavity intermediate the outer barrier and the inner food package(s). The inner foodstuff barrier essentially functions to prevent contact intermediate the inner and outer foodstuffs, and the outer foodstuff barrier essentially functions to prevent contact intermediate the outer foodstuff and radially ambient matter.

The first and second package ends are sealed for selectively preventing contact intermediate the inner and outer foodstuffs and axially ambient matter. In this regard, it is contemplated that a multiaxial foodstuff package may be gleaned from the teachings set forth herein wherein the foodstuff package may comprises plural inner foodstuffs bound by certain inner foodstuff barriers and a single outer foodstuff which fills the interstitial space intermediate the inner foodstuff barrier(s) and the outer foodstuff barrier. Further, in terms of a foodstuff presentation method, the method for presenting plural foodstuffs to a foodstuff consumer may be said to comprise the steps of axially displacing axially aligned plural foodstuffs along the foodstuff axes for axially presenting plural foodstuffs to a foodstuff consumer; and presenting the axially aligned and axially displaced foodstuffs to the foodstuff consumer. This method may be preferably defined by coaxially aligning the plural foodstuffs or ingredients prior to axial displacement.

It will be seen that the types of ingredients storable in the package do not necessarily have to be overtly reactionary with one another as would be the case with gasified candy and moisture-laden ingredients such as pudding. The package may well function to separate ingredient pairs and the like such as cottage cheese on the outside and a fruit sauce on the inside (similar to the ingredients of BREAKSTONE'S®/KNUDSEN® COTTAGE DOUBLES® brand(s) snack packs); chocolate sauce on the outside and marshmallow cream on the inside; pudding on the outside and whipped cream on the inside; peanut butter on the outside and jelly on the inside; ketchup on the outside and mustard on the inside; and pudding on the outside and gasified candy on the inside. The package can be manufactured so that the contents including both foodstuffs can be visible through the transparency of the film used for the package or the exterior product can be partially seen through the transparency of the film so that the outer package can also carry the brand name and advertising of the manufacturer as needed.

The foregoing may be said to further teach or disclose certain methodology for manufacturing the coaxial ingredient package. In this regard, it is noted that coaxial ingredient package may be finally formed by first forming an ingredient-receiving inner tube, the inner tube having first and second inner tube ends and a longitudinal tube axis, the first inner tube end being sealed, the second inner tube end being open. A first ingredient may then be properly deposited into the inner tube via the second inner tube end, the first ingredient extending in radial adjacency to the tube axis. A matter-receiving outer tube may also be formed, which outer tube has first and second outer tube ends, the first outer tube end being sealed, the second outer tube end being open. A second ingredient and the inner tube may then be deposited into the outer tube via the second outer tube end, the inner and outer tubes and the first and second ingredients being substantially coaxial. The second inner and outer tube ends may then be (simultaneously) sealed (to one another) thereby finally forming a coaxial ingredient package.

It is further contemplated that the inner and outer tubes may be vertically and/or coaxially aligned before depositing the second ingredient and the inner tube into the outer tube. Further, it is noted that the finally formed coaxial ingredient package has first and second package ends. In this regard, it is contemplated that a select package end may be scored after sealing the second inner and outer tube ends, the select package end being selected from the group consisting of the first and second package ends. Preferably, the inner tube is lap-sealed during inner tube formation, whereas the outer tube may be selectively sealed during outer tube formation. In this regard, it is contemplated that the outer tube may be sealed as selected from the sealing type group consisting of lap sealing and fin sealing.

It is further contemplated that the inner tube with upper and lower ends open may be fed through the second forming collar and make and the bottom seals of the inner and outer tube may be formed simultaneously. The inner and outer product or first and second ingredients could then be fed or deposited into the inner and outer tubes via the open ends at the same time and the top seal for both the inner and outer tubes could be made at the same time. This approach may help the filling process if the inner product would have the tendency to bow out and choke off the outer package.

It is thus contemplated that the method of manufacturing a unidirectional or coaxial ingredient package, which method may comprise the steps of initially forming at least one ingredient-receiving inner tube and an outer ingredient-receiving outer tube (for receiving the inner tube(s)), the inner and outer tubes each having first and second tube ends and unidirectional tube axes. Notably, the unidirectional tube axes may be preferably coaxially aligned for forming a coaxial unidirectional package. After the inner and outer tubes are formed, first inner and outer tube ends may be (simultaneously) sealed, thereby leaving the second inner and outer tube ends open for subsequent ingredient deposition. After depositing a first ingredient into the inner tube and a second ingredient into the outer tube via the open second tube ends, the second inner and outer tube ends may be sealed for finally forming the unidirectional ingredient package.

Accordingly, although the invention has been described by reference to preferred embodiments, certain alternative embodiments, and certain methodology, it is not intended that the novel assembly or methods be limited thereby, but that modifications thereof are intended to be included as falling within the broad scope and spirit of the foregoing disclosure, the following claims and the appended drawings.

The invention claimed is:

1. A method of manufacturing coaxial foodstuff packages, the method comprising the steps of:

vertically sealing longitudinal edges of a first packaging material thereby forming a first tubular sleeve with opposite sleeve ends left open;

vertically sealing longitudinal edges of a second packaging material thereby forming a second tubular sleeve with opposite sleeve ends left open, the second tubular sleeve being formed about the first inner tubular sleeve;

simultaneously transversely sealing inferior ends of the first and second tubular sleeves forming open-ended inner and outer foodstuff-receiving compartments;

depositing a first foodstuff into the open-ended inner foodstuff-receiving compartment;

depositing a second foodstuff into the open-ended outer foodstuff-receiving compartment about the inner foodstuff receiving compartment;

simultaneously transversely sealing superior ends of the inner and-outer foodstuff-receiving compartments to form a coaxial foodstuff package, the first and second foodstuffs being coaxially compartmentalized; and cutting the coaxial foodstuff package intermediate the superior transverse seal to separate the coaxial foodstuff package from the first and second packaging materials for removing the coaxial foodstuff package from the first and second packaging materials with a portion of the superior seal below the cut forming a superior sealed end of the coaxial foodstuff package and a portion of the superior seal above the cut forming the inferior end of the next coaxial foodstuff package to be formed.

2. A method of manufacturing coaxial ingredient packages, the method comprising the steps of:

coaxially aligning first and second ingredient-delivery collars about a vertical tube-forming axis;

forming an ingredient-receiving inner tube about the first ingredient-delivery collar, the inner tube being formed from a continuous sheet of first packaging film, the first packaging film having inner and outer first film surfaces;

vertically lap-sealing the inner first film surface to the outer first film surface, the inner tube having first and second inner tube ends;

coaxially displacing the inner tube through the second ingredient-delivery collar;

forming a matter-receiving outer tube about the inner tube via the second ingredient delivery collar, the outer tube being formed from a continuous sheet of second packaging film, the second packaging film having inner and outer second film surfaces;

vertically fin-sealing the inner second film surface unto itself, the outer tube having first and second outer tube ends;

simultaneously transversely sealing the first inner and outer tube ends;

depositing a first ingredient into the inner tube via the first ingredient-delivery collar and the second inner tube end;

depositing a second ingredient into the outer tube about the inner tube via the second ingredient-delivery collar and the second outer tube end;

simultaneously transversely sealing the second inner and outer tube ends thereby forming a second transverse seal;

transversely cutting across and intermediate the second transverse seal, thereby separating a coaxial ingredient package from inner and outer tubes, wherein a portion of the second transverse seal below the cut forms a substantially hermetically sealed second end of the coaxial ingredient package and a portion of the second transverse seal above the cut forms a substantially hermetically sealed first end of a next coaxial ingredient package to be formed.

3. The method of claim 2 wherein the first outer tube end is transversely sealed about the first inner tube end.

4. The method of claim 3 wherein the coaxial ingredient package is coaxially displaced to a package removal position before being cut from the first and second packaging films.

5. The method of claim 2 wherein the coaxial ingredient package has first and second package ends, a select package end being transversely scored after sealing the second inner and outer tube ends, the select package end being selected from the group consisting of the first and second package ends wherein the score penetrates both the inner and outer tubes at a location between the first and second package ends to facilitate opening of the inner and outer tubes simultaneously.

6. A method of manufacturing ingredient packages, the method comprising the steps of:

positioning first and second package-forming, ingredient-delivery collars;

forming an ingredient-receiving inner tube from a continuous sheet of packaging film about the first ingredient-delivery collar, the inner tube having first and second inner tube ends;

displacing the inner tube through the second ingredient-delivery collar;

forming a matter-receiving outer tube from a continuous sheet of packaging film about the inner tube via the second ingredient delivery collar, the outer tube having first and second outer tube ends;

simultaneously transversely sealing the first inner and outer tube ends;

depositing a first ingredient into the inner tube via the first ingredient-delivery collar and the second inner tube end;

depositing a second ingredient into the outer tube about the inner tube via the second ingredient-delivery collar and the second outer tube end;

simultaneously transversely sealing the second inner and outer tube ends by sealing the second outer tube about the second inner tube end; and transversely cutting across and intermediate the transverse seal at the second inner and outer tube ends thereby separating a coaxial ingredient package from the continuous sheets of packaging film, wherein a portion of the transverse seal below the cut forms a sealed second end of the coaxial ingredient package and a portion of the transverse seal above the cut forms a sealed first end of a subsequent coaxial ingredient package.

7. The method of claim 6 wherein the step of positioning the first and second ingredient-deliver collars is defined by a substantially vertical coaxial alignment.

8. The method of claim 7 wherein the inner tube is lap-sealed during inner tube formation and the outer tube is selectively sealed during outer tube formation, the outer tube being sealed as selected from the sealing type group consisting of lap sealing and fin sealing.

9. The method of claim 6 wherein the coaxial ingredient package is coaxially displaced to a package removal position before the step of being removed from the continuous sheets of packaging film.

10. The method of claim 6 wherein the ingredient package has first and second package ends, a select package end being transversely scored after sealing the second inner and outer tube ends, the select package end being selected from the group consisting of the first and second package ends and wherein at least a portion of the score penetrates both the inner and outer tubes at a location intermediate the first and second package ends to facilitate simultaneous opening of the inner and outer tubes.

11. A method of manufacturing coaxial ingredient packages from continuous films of packaging material, the method comprising the steps of:

forming an ingredient-receiving inner tube from a continuous film of packaging material, the inner tube having first and second inner tube ends and a longitudinal tube axis, the first inner tube end being sealed, the second inner tube end being open;

depositing a first ingredient into the inner tube via the second inner tube end, the first ingredient extending in radial adjacency to the tube axis;

forming a matter-receiving outer tube, the outer tube having first and second outer tube ends;

depositing the inner tube into the outer tube via the second outer tube end, transversely sealing the outer tube about the first inner tube end seal;

depositing a second ingredient into the outer tube and about the inner tube, the inner and outer tubes and the first and second ingredients being substantially coaxial;

transversely heat sealing the second inner and outer tube ends wherein the second outer tube end is formed about the transverse seal at the second inner tube end; and transversely cutting across the second inner and outer tube end seals at a location intermediate the seals wherein the portion of the seals below the cut form a second end seal for a coaxial ingredient package and a portion of the seals above the cut form a first end seal of a subsequently formed coaxial ingredient package.

12. The method of claim 11 wherein the inner and outer tubes are coaxially aligned before depositing the second ingredient and the inner tube into the outer tube.

13. The method of claim 11 wherein the inner and outer tubes are vertically aligned before depositing the second ingredient and the inner tube into the outer tube.

14. The method of claim 11 wherein the coaxial ingredient package has first and second package ends, a select package end being scored after sealing the second inner and outer tube ends, the select package end being selected from the group consisting of the first and second package ends and wherein at least a portion of the score penetrates both the inner and outer tubes at a location intermediate the first and second package ends to facilitate simultaneous opening of the inner and outer tubes.

15. The method of claim 11 wherein the inner tube is lap-sealed during inner tube formation and the outer tube is selectively sealed during outer tube formation, the outer tube being sealed as selected from the sealing type group consisting of lap sealing and fin sealing.

16. A method of manufacturing multi-ingredient packages, the method comprising the steps of:

forming ingredient-receiving inner and outer tubes from continuous inner and outer tube films, the inner and outer tubes each having first and second tube ends and unidirectional tube axes;

simultaneously transversely heat sealing the first tube ends, the second tube ends being open;

depositing a first ingredient into the inner tube and a second ingredient into the outer tube via the open second tube ends;

simultaneously transversely heat sealing the second tube ends thereby finally forming a unidirectional ingredient package; and transversely cuffing across the second tube end seals at a location intermediate the second tube end seals wherein a portion of the seals below the cut form a second end seal of a first multi-ingredient package and a portion of the seals above the cut form a first end seal of a subsequent multi-ingredient package.

17. The method of claim 16 wherein the inner and outer tubes are coaxially aligned before depositing the first and second ingredients into the inner and outer tubes.

18. The method of claim 16 wherein the outer tube first tube end is sealed about the first tube end inner seal.

19. The method of claim 16 wherein the multi-ingredient package has first and second package ends, a select package end being scored after sealing the second tube ends, the select package end being selected from the group consisting of the first and second package ends and wherein at least a portion of the score penetrates both the inner and outer tubes at a location intermediate the first and second package ends to facilitate simultaneous opening of the inner and outer tubes.

20. The method of claim 16 wherein the inner tube is lap-sealed and the outer tube is selectively sealed during inner and outer tube formation, the outer tube being sealed as selected from the sealing type group consisting of lap sealing and fin sealing.

* * * * *

UNITED STATES PATENT AND TRADEMARK OFFICE

CERTIFICATE OF CORRECTION

PATENT NO. : 7,726,098 B2
APPLICATION NO. : 11/742791
DATED : June 1, 2010
INVENTOR(S) : Doll It is certified that error appears in the above-identified patent and that said Letters Patent is hereby corrected as shown below:

- In Col. 15, Line 12, Claim 1, delete “and-outer” and insert -- and outer --.

- In Col. 18, Line 18, Claim 16, delete “cuffing” and insert -- cutting --.

Signed and Sealed this

Twenty-third Day of November, 2010

David J. Kappos

David J. Kappos
*Director of the United States Patent and Trademark Office*